United States Patent [19]

Ikio

[11] 4,086,231

[45] Apr. 25, 1978

[54] COKE OVEN DOOR CONSTRUCTION

[76] Inventor: Takatoshi Ikio, 5-32, 1 chome, Senbo, Tobata-ku, Kitakyushu-shi, Japan

[21] Appl. No.: 626,326

[22] Filed: Oct. 28, 1975

[30] Foreign Application Priority Data

Oct. 31, 1974 Japan ..... 49-125996

[51] Int. Cl.[2] ..... C10B 25/16

[52] U.S. Cl. ..... 202/248; 49/480; 202/269

[58] Field of Search ..... 202/242, 243, 247, 248, 202/269; 49/480, 481, 485, 209

[56] References Cited

U.S. PATENT DOCUMENTS

| | | | |
|---|---|---|---|
| 1,399,594 | 12/1921 | Wilputte | 202/242 X |
| 2,126,239 | 8/1938 | Beimann | 202/248 |
| 2,209,590 | 7/1940 | Wilputte | 202/248 |
| 2,442,348 | 6/1948 | Exum | 202/248 |
| 2,867,012 | 1/1959 | Emley, Jr. | 49/480 |
| 2,965,550 | 12/1960 | McClure | 202/248 |
| 3,032,483 | 5/1962 | Van Ackeren et al. | 202/248 |
| 3,881,995 | 5/1975 | White, Jr. | 202/248 |

FOREIGN PATENT DOCUMENTS

| | | | |
|---|---|---|---|
| 401,698 | 11/1974 | U.S.S.R. | 202/248 |

*Primary Examiner*—Morris O. Wolk
*Assistant Examiner*—Arnold Turk
*Attorney, Agent, or Firm*—McGlew and Tuttle

[57] ABSTRACT

A coke oven door for a coke oven which has an oven opening with a receiving frame extending around the opening comprises a door body with a sealing plate secured to the face of the door body which is adapted to close the oven opening. The sealing plate is of thin metal material and is held in spaced relationship to the front face of the door body by spacers. The plate includes an annular peripheral portion with an inturned flange directed inwardly toward the receiving frame. Spring biasing means mounted on the door engage against the rear edge of the flange at spaced locations around its periphery and bias the flange inwardly into sealing engagement with the receiving frame.

4 Claims, 5 Drawing Figures

COKE OVEN DOOR CONSTRUCTION

BACKGROUND OF THE INVENTION

FIELD OF THE INVENTION

This invention relates in general to the construction of coke ovens and in particular to a new and useful door for a coke oven having a sealing plate secured to a front face of the door body and spaced outwardly from the front face by spacers so as to define an insulation space therebetween and which includes an annular inturned flange engaged against the receiving frame and biased inwardly against the frame by biasing means to seal the periphery of the plate to the coke oven receiving frame.

Prior to the present invention it has been known to seal the periphery of a coke oven door with an annular receiving frame surrounding the opening of a coke oven by means of a door body which has knife edges mounted on the sides thereof in close contact with the body and which engage against the receiving frame. A disadvantage of this construction is that the knife edges become subjected to extremely high temperatures and they tend to conduct the heat directly to the door body so as to cause a warping or destruction of the door body due to the temperature stresses in a short period of time. This condition is aggravated because of the great temperature differences generated between the inner surface of the door body and the exterior of the coke oven and the door body. In a short time the knife edges which are secured directly to the door body are distorted to the extent that they no longer form a firm sealing with the receiving frame. This means that gas or black smoke will leak from the oven to the exterior. In order to prevent this there have been attempts to form a door body with a knife edge provided only on portions thereof and wherein there is a crevice formed between the door and the frame so that leakage may be prevented. Such a construction does not operate satisfactorily in view of the very great heights of the doors which may reach seven meters or more and the fact that the construction still made the edges subject to extreme radiant heat from the coke oven walls. In respect to attempts to strengthen the doors so that they will not distort it was found that the total weight of the door body becomes increased to an undesirable extent so that the opening and closing and the attaching and detaching operations for the door become difficult and expensive. In addition these attempts have not proved too successful in preventing all distortion of the doors.

SUMMARY OF THE INVENTION

In accordance with the present invention there is provided a door for a coke oven which has an opening with a receiving frame extending around the opening, a door body which has a front face facing the oven which is covered by a sealing plate which is secured to the door body and held in spaced relationship to the front face by spacers. The sealing plate has an inturned flange which is directed inwardly toward the receiving frame and it is biased at spaced locations around its periphery by spring biasing means into firm sealing engagement with the receiving frame in order to effectively seal the periphery of the plate to the coke oven. With such a construction the door body itself is not subjected to thermal stresses which will cause undue bending or distortion. The periphery of the sealing plate may be biased into sealing engagement with the receiving frame and the biasing may be adjusted so that no crevices will develop through which gas or black smoke may issue. The construction also makes it possible to easily fit the sealing plate to the receiving frame and the plate may be made of lightweight material so that the weight of the coke oven door is not materially increased.

Accordingly it is an object of the invention to provide an improved coke oven door which includes a sealing plate attached to the front or oven facing face of the door body and which is spaced outwardly from the door body to define an insulation space therebetween by spacers and wherein the sealing plate includes an annular inturned flange defining sealing edges which are biased against the receiving frame of the coke oven by spring biasing elements.

A further object of the invention is to provide a door frame which includes a separate sealing plate which is spaced from and insulated from the door body and which includes an inturned flange defining an annular sealing edge which is pressed against a receiving frame by a plurality of separately adjustable spring elements arranged around its periphery and bearing against the exterior face of the sealing plate to urge it toward the receiving frame.

A further object of the invention is to provide a coke oven door which is simple in design, rugged in construction and economical to manufacture and which may be easily fitted to a coke oven receiving frame surrounding the coke oven opening.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PRIOR ART

Figure 5:
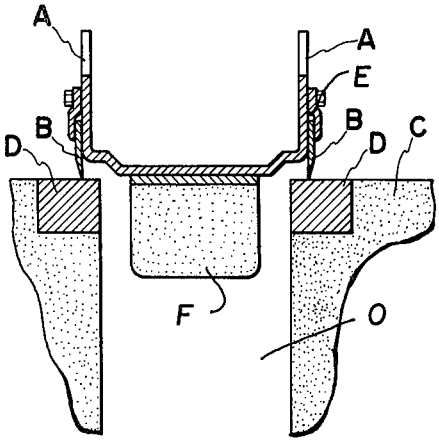
FIG. 5 (PRIOR ART)
FIG. 5 is a partial sectional view of a coke oven door having a knife edge secured directly to the door as constructed in accordance with the prior art.

Referring to FIG. 5 there is shown a known construction of a coke oven door in accordance with the prior art which includes a door body A having knife edges B secured directly to the body for example by clamps E. The knife edges B bear against an annular receiving frame D of a coke oven C. The body A includes the usual refractory central portion F which is secured to the front face of the door body and extends into the opening O of the coke oven C. The disadvantage of the known construction is that the great temperatures which are generated in the coke oven C are sufficient to cause thermal stresses in both the sealing knife edge plates B and the coke oven door body A with the result that they cause a bending and distortion of the door body and thus destroy the sealing engagement of the door body in the coke oven opening O. This means that gas and black smoke will soon leak outwardly through the crevices between the knife edge plate B and receiving frame D.

GENERAL DESCRIPTION OF THE PREFERRED EMBODIMENT

Figure 1:
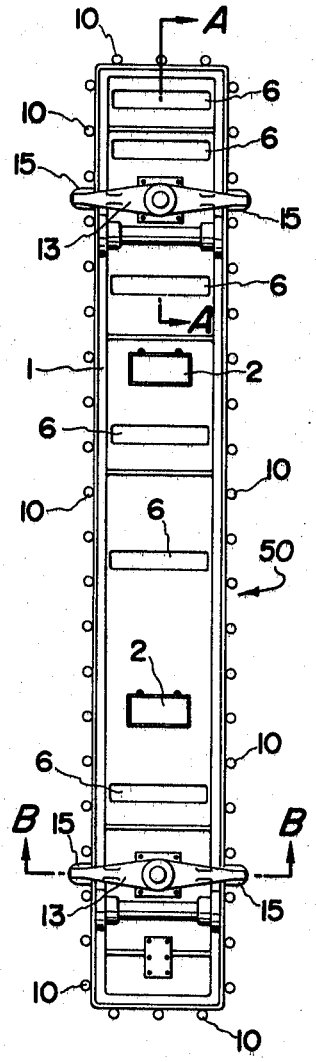
FIG. 1 is a rear elevational view of a coke oven door constructed in accordance with the invention.
Figure 2:
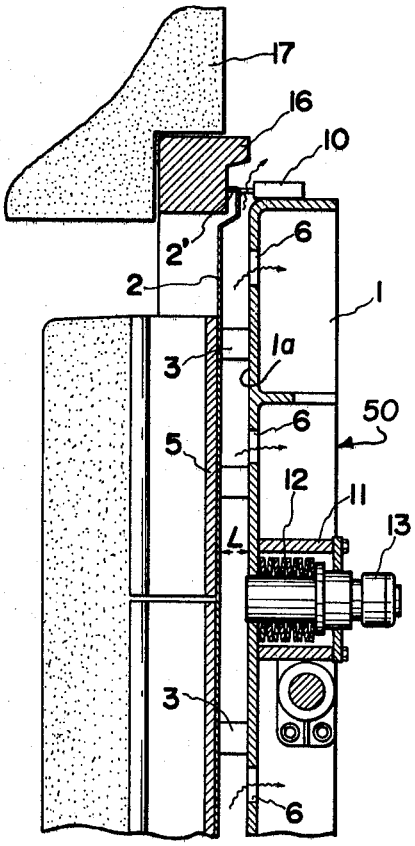
FIG. 2 is a partial sectional view taken along the line A—A of FIG. 1.
Figure 3:
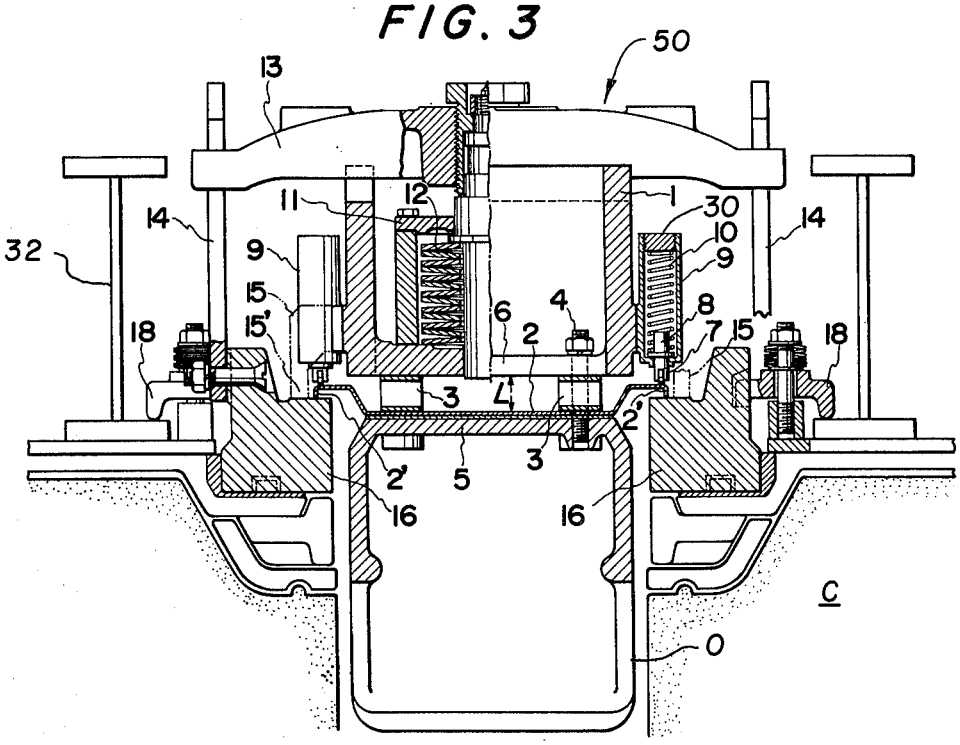
FIG. 3 is a section taken along the line B—B of FIG. 1.

Referring to the drawings in particular the invention embodied therein in FIGS. 1 to 3 comprises a door generally designated 50 for a coke oven C which has a receiving frame 16 which extends completely around an opening O of the coke oven. In accordance with the invention the coke oven door 50 includes a door body 1 having an inner or front face 1*a* which is covered by a sealing plate 2. The sealing plate 2 is held in spaced relationship to the front face 1*a* by means of spacers 3 and securing bolts 4 which extend through the spacers and are secured to the sealing plate 2 and to a central portion or brick support frame 5 which is adapted to extend into the opening O during the closure of the door.

In accordance with a feature of the invention the sealing plate 2 which is made of a light metal material such as stainless steel is provided with inwardly extending edges or flanges 2' which extend inwardly toward engagement with the receiving frame 16. The flanges 2' comprise annular flanges which are held in tight sealing engagement with the receiving frame 16 by biasing means which in the embodiment illustrated comprises a plurality of separate springs 10 which are arranged around the periphery of the exterior side of the sealing plate and are engaged at their inner ends around bolts 8 of biasing member 7 which are urged by the springs against the outer edges of the sealing plate. The springs are contained in holders 9 which are formed at the sides of the door body the springs 10 which may be adjustable by adjusting threaded nut members 30 in respect to the holders 9 so as to provide a biasing force around the periphery of the flange portion 2' to hold the flange in tight sealing engagement with the sealing frame 16 at all times.

The spacers 3 hold the sealing plate 2 away from the door body 1 and they define a vent space L therebetween which may be left void to permit circulation of air therebetween which may be vented outwardly through an opening 6. Cool air may be supplied into the void space L and evacuated through the air vent opening 6. Alternatively it is possible to fill the space L with an adiabatic material such as glass wool to provide an insulation between the plate 2 and the door body 1.

The door body 1 also accommodates a locking mechanism 11 which includes flat plate springs 12 to apply a pressure on a locking bar engagement arm 14 through a locking bar 13. The arm 14 is secured to the receiving frame 16. The door body includes a support arm 15 which extends outwardly from a side thereof and it has an outer or front tip 15' which bears against the receiving frame 16. A plurality of clamp members having knife edges 18 are also clamped between the receiving frame 16 and a support structure 32 on the exterior of the coke oven C.

Figure 4:
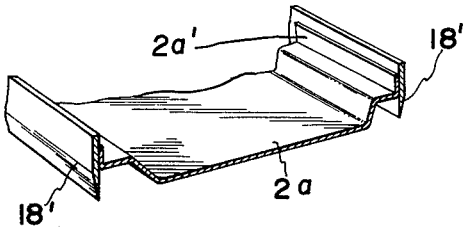
FIG. 4 is a partial perspective view of another embodiment of the sealing plate.

An alternate structure of a sealing plate 2*a* is shown in FIG. 4 wherein rearwardly extending flanges 2*a'* provide means for securing knife edges 18' thereto.

The door body 1 may be swung inwardly and outwardly in respect to the opening O by a lifter mechanism (not shown).

With the inventive arrangement bending of the door body is prevented and the annular flange 2' of the sealing plate 2 is biased by the individual springs 10 toward the receiving frame 16. If the door body does become bent, the sealing plate may be adjusted by the springs to close any crevices which might possibly form. Thus a secure means for preventing the leakage of gas is provided.

By providing a space L between the sealing plate 2 and the door body 1 it is possible to circulate a cooling gas between these parts continuously if desired. Thus the conduction of high temperatures in a coke oven through to the door body will be substantially prevented.

The support arm 15 which projects from the door body 1 will be in contact with the receiving frame 16 to adjust the position of the door body and the receiving frame so that no excess forces may act on the sealing plate 2.

The sealing plate may comprise a flat thin plate preferably of a stainless steel or an alloy resistant to heat. Such a plate may be easily cleaned in the event that any tar or pitch material adheres to it.

While a specific embodiment of the invention has been shown and described in detail to illustrate the application of the principles of the invention, it will be understood that the invention may be embodied otherwise without departing from such principles.

What is claimed is:

1. A door for a coke oven having an oven opening with a receiving frame extending around the opening, comprising a door body having a front face facing the oven, a sealing plate secured to said door body front face and having an annular peripheral portion with an inturned flange directed inwardly toward the receiving frame, a plurality of spacer means between said sealing plate and said door body holding said sealing plate in spaced relationship to said door body and defining a vent space therebetween, a plurality of vent openings in said door body along the height thereof for venting said space along its complete height, biasing means biasing said flange against the receiving frame to seal the periphery of said plate to the coke oven receiving frame, and a support arm extending outwardly from each side of said body adjacent the upper and lower portions thereof and bearing against the receiving frame to adjust the position of the door body with respect to the frame, wherein said biasing means include a plurality of spring holders carried by said door body, a member movable in each spring holder and engageable with said flange on the exterior thereof, and a spring in each holder biasing said member against said flange.

2. A door for a coke oven according to claim 1, including a brick work frame secured to said sealing plate and adapted to extend inwardly into the oven from said sealing plate.

3. A door according to claim 1, wherein said inturned flange includes a knife edge bearing against the receiving frame.

4. A door according to claim 1, wherein said spacer means comprise hollow spacers extending between said sealing plate and said door body and a bolt extending through said hollow spacers holding said sealing plate to said door body.

* * * * *